United States Patent [19]

Buchholz

[11] 4,114,264

[45] Sep. 19, 1978

[54] CLIPPER MECHANISM

[75] Inventor: Alexis Emmanuel Buchholz, Hauterive, Switzerland

[73] Assignee: The Gillette Company, Boston, Mass.

[21] Appl. No.: 809,686

[22] Filed: Jun. 24, 1977

[30] Foreign Application Priority Data

Jun. 29, 1976 [GB] United Kingdom ..... 27109/76

[51] Int. Cl.[2] ..... B26B 19/10

[52] U.S. Cl. ..... 30/34.1

[58] Field of Search ..... 30/34.1

[56] References Cited

U.S. PATENT DOCUMENTS

| | | | |
|---|---|---|---|
| 2,370,543 | 2/1945 | Jepson | 30/34.1 |
| 2,370,544 | 2/1945 | Jepson | 30/34.1 |
| 2,371,242 | 3/1945 | Jenson | 30/34.1 |
| 3,440,724 | 4/1969 | Wich | 30/34.1 |

*Primary Examiner*—Gary L. Smith

*Attorney, Agent, or Firm*—Richard A. Wise; Donald E. Mahoney

[57] ABSTRACT

An electric dry shaver comprising a cutter mounted for arcuate oscillation about an axis to effect a shaving action, a driver secured to said cutter for arcuate oscillation about said axis, a trimmer element mounted for linear reciprocation parallel to said cutter axis to effect a hair trimming action, and a coupling mechanism selectively engageable between said driver and said trimmer element to convert arcuate driver oscillation into linear trimmer reciprocation via the intermediary of a cranked lever mounted for pivotal oscillation about an axis perpendicular to both the cutter axis and the trimmer element.

9 Claims, 6 Drawing Figures

CLIPPER MECHANISM

BACKGROUND OF THE INVENTION

This invention relates to a clipper or long hair trimmer for an electric shaver, more particularly an electric dry shaver of the type having an arcuately oscillating cutter.

A dry shaver trimmer commonly comprises a fixed trimmer blade and a cooperating movable trimmer blade projecting from the side of the shaver body at the base of the cutter head. In the case of a shaver having a linearly reciprocating shaving cutter, only a simple coupling is required to connect the movable trimmer blade to the reciprocating cutter, but in the case of a shaver having an arcuately oscillating cutter, a simple drive to produce linear reciprocation of the movable trimmer blade is less easy to devise. An entirely separate drive may be taken from the motor output shaft, but the mechanism involved will be relatively complex and expensive. On the other hand, there are problems in producing a simple coupling mechanism which will convert the angular oscillation of the main cutter into linear reciprocation of the movable trimmer blade, and these problems are increased if optional operation of the trimmer is required. The present invention provides a solution to these problems.

SUMMARY OF THE INVENTION

According to the invention there is provided an electric dry shaver comprising a cutter mounted for arcuate oscillation about an axis to effect a shaving action, a driver secured to said cutter for arcuate oscillation about said axis, a trimmer element mounted for linear reciprocation parallel to said cutter axis to effect a hair trimming action, and a coupling mechanism operably interposed between said driver and said trimmer element, said mechanism being selectively operatively engageable and disengageable with said driver respectively to establish and to break a driving connection between said driver and said trimmer element.

BRIEF DESCRIPTION OF DRAWINGS

An embodiment of the invention will now be described, by way of example, with reference to the accompanying drawings, in which.

DESCRIPTION OF PREFERRED EMBODIMENT

Figure 1:
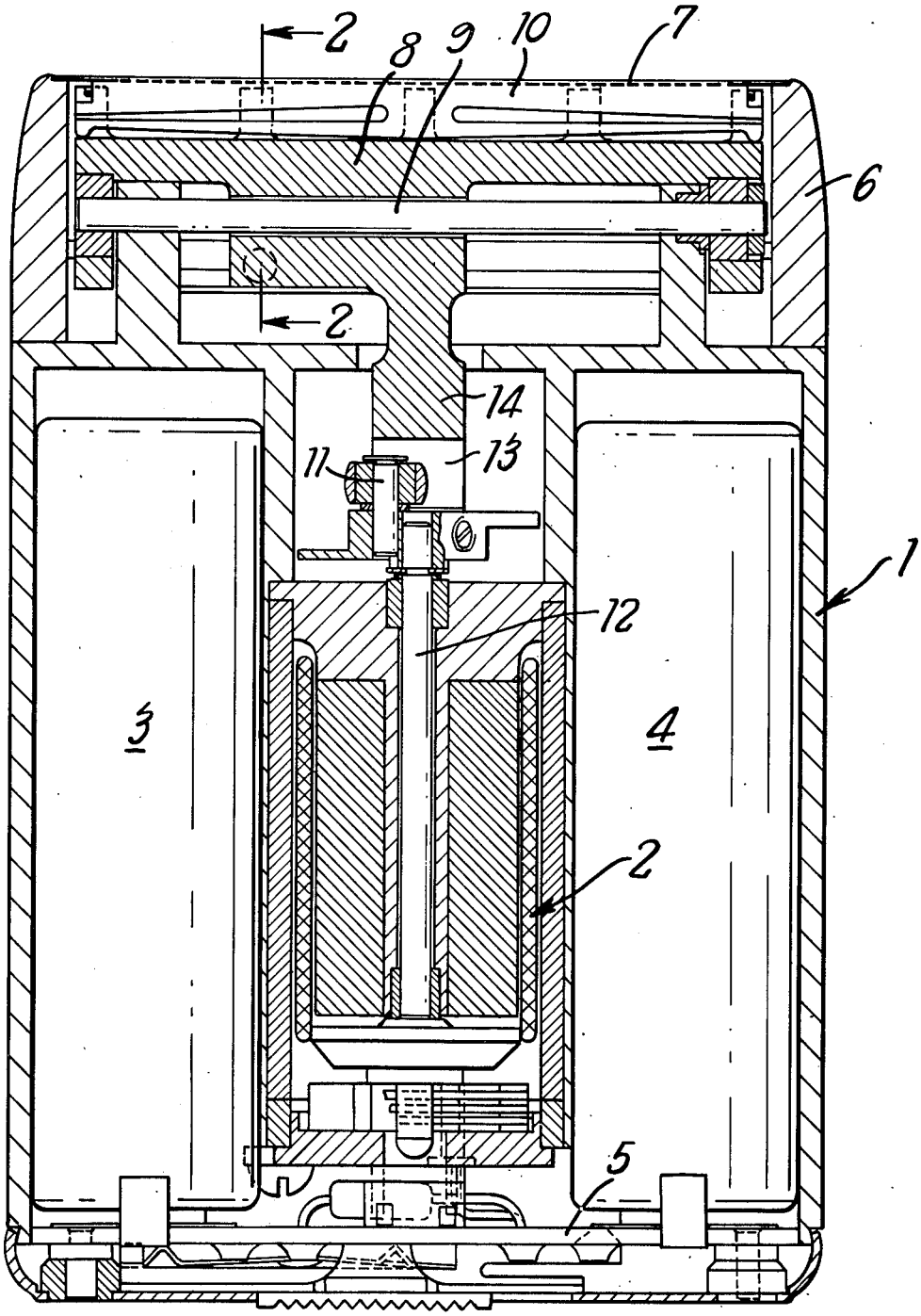
FIG. 1 is a vertical section through a dry shaver according to the invention.

Referring to FIG. 1 there is shown an electric dry shaver comprising a housing 1 receiving an electric motor 2 powered by two batteries 3 and 4 through electrical connections on a circuit board 5. The housing carries a removable cutter head 6 carrying a cutter foil 7. A cutter block 8 is mounted for arcuate oscillation about a shaft 9, and carries a plurality of longitudinally extending cutter blades 10 resiliently biassed into cooperation with the foil 7 to effect a shaving action. The cutter block 8 is driven in arcuate oscillation by means of an eccentrically mounted drive pin 11, driven in rotation about the axis of the shaft 12 of the motor 2, and working in a transverse slot 13 in a lever portion 14 depending from the cutter block 8.

Figure 2:
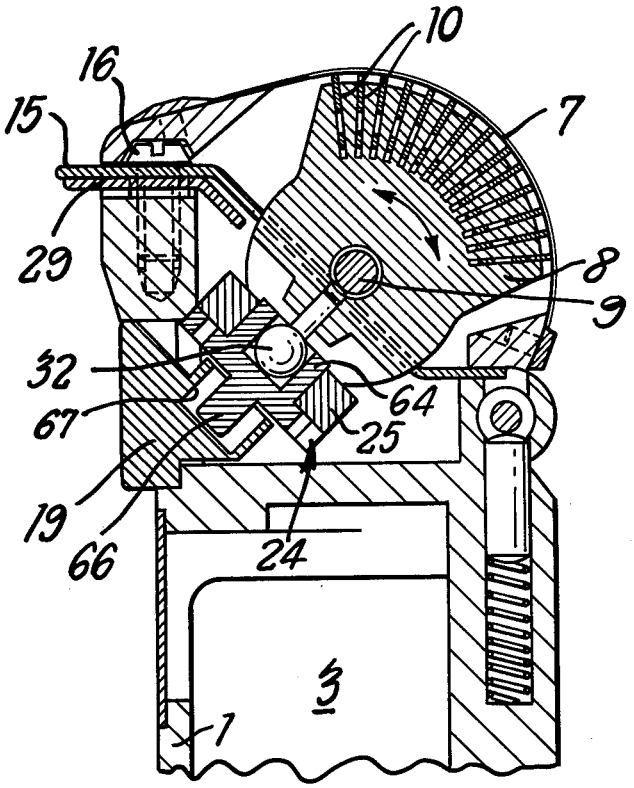
FIG. 2 is a cross-section on line 2—2 of FIG. 1.

The present invention is concerned with the selective transmission of drive from the arcuately oscillating cutter block 8 to a hair trimmer incorporated in the shaver. The trimmer is best seen in FIG. 2 as comprising a stationary upper toothed blade 15 secured to the shaver body by screws 16, and a lower toothed blade 29 mounted for linear reciprocation parallel to the upper blade and parallel to the axis of the shaft 9. The lower blade 29 is slotted to accommodate passage of screws 16, and is resiliently urged against blade 15. These and other details of the trimmer itself will be familiar to those skilled in the art, as will other details of the dry shaver as a whole.

Figure 3:
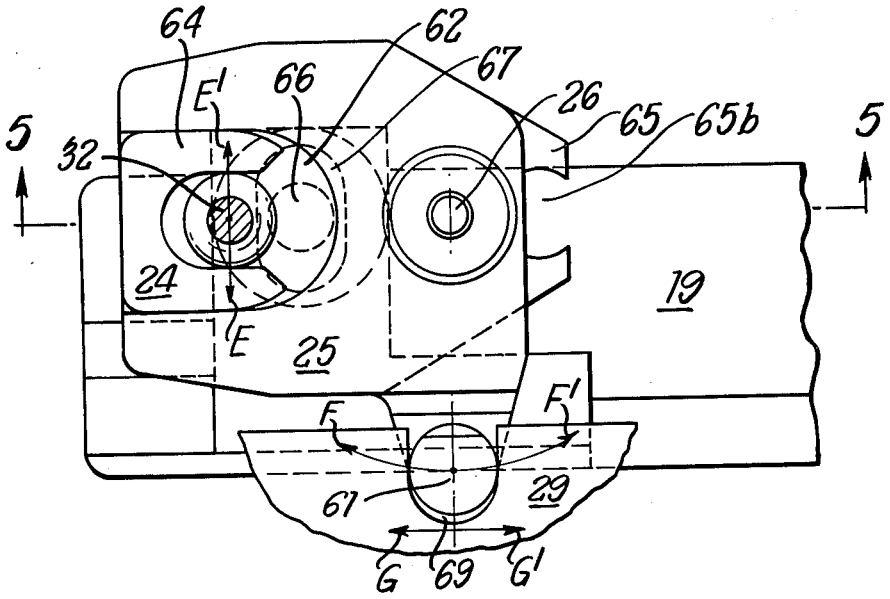
FIGS. 3 and 4 are fragmentary views of the trimmer coupling mechanism of the shaver respectively in the operative and the inoperative positions.
Figure 4:
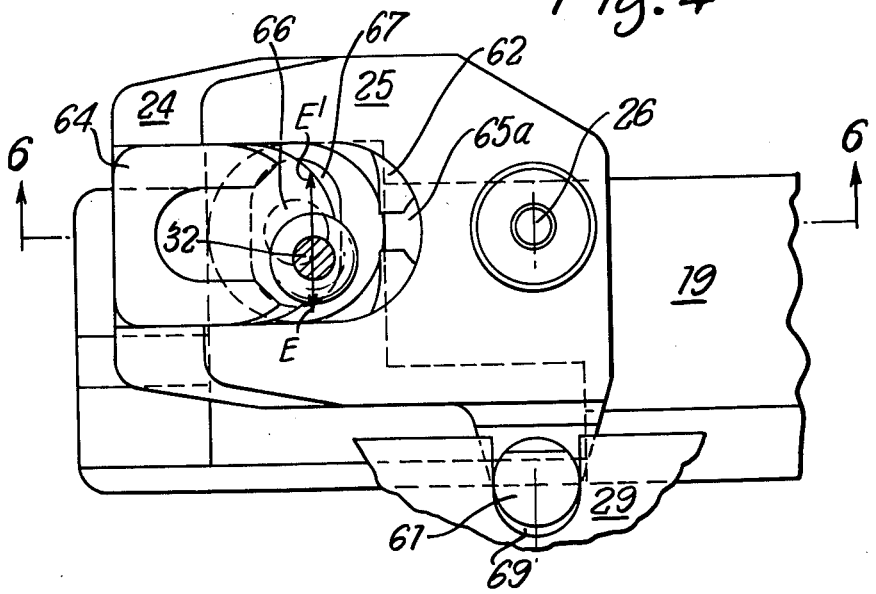
Figure 5:
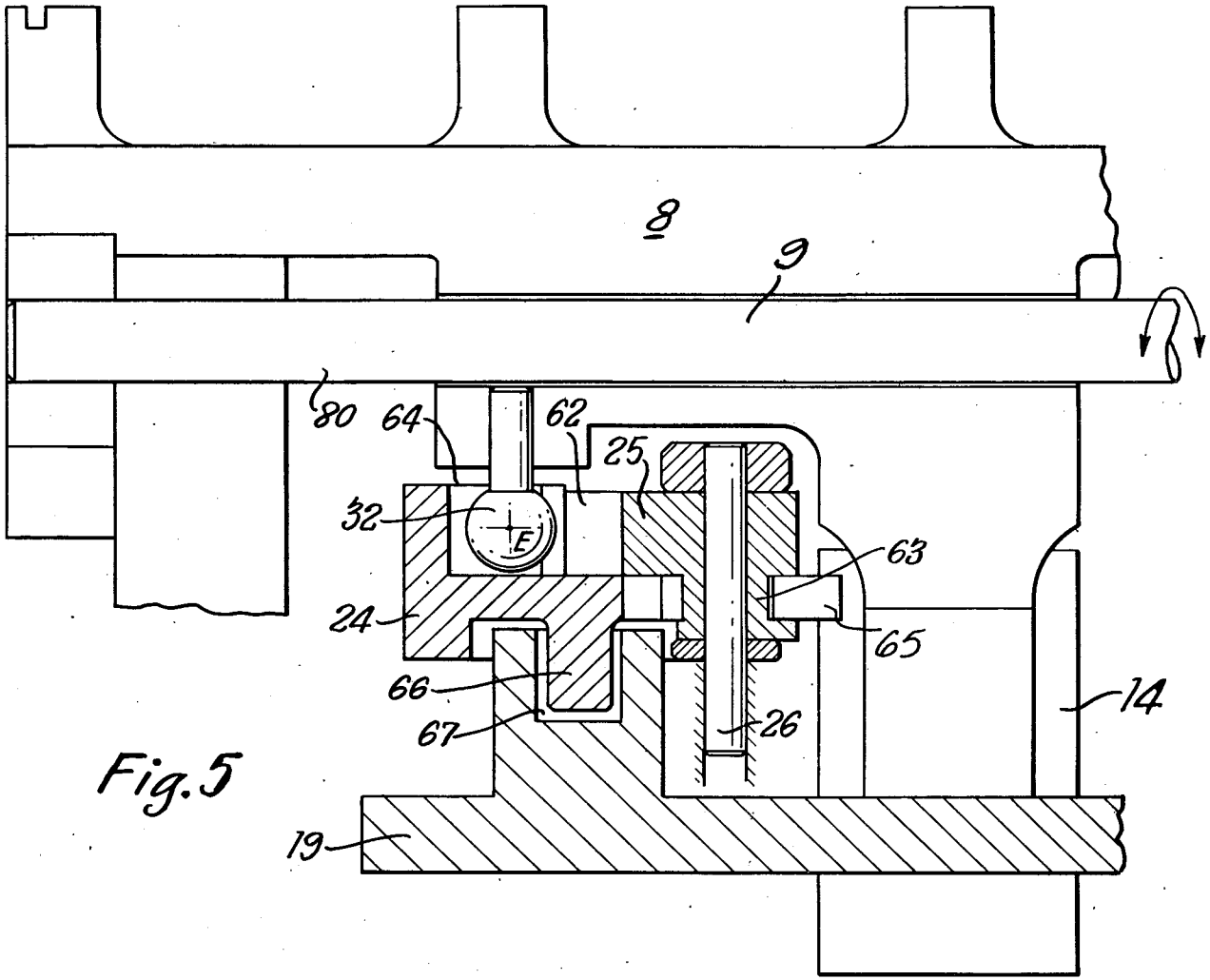
FIGS. 5 and 6 are sections on lines 5-5 and 6—6, respectively, of FIGS. 3 and 4.
Figure 6:
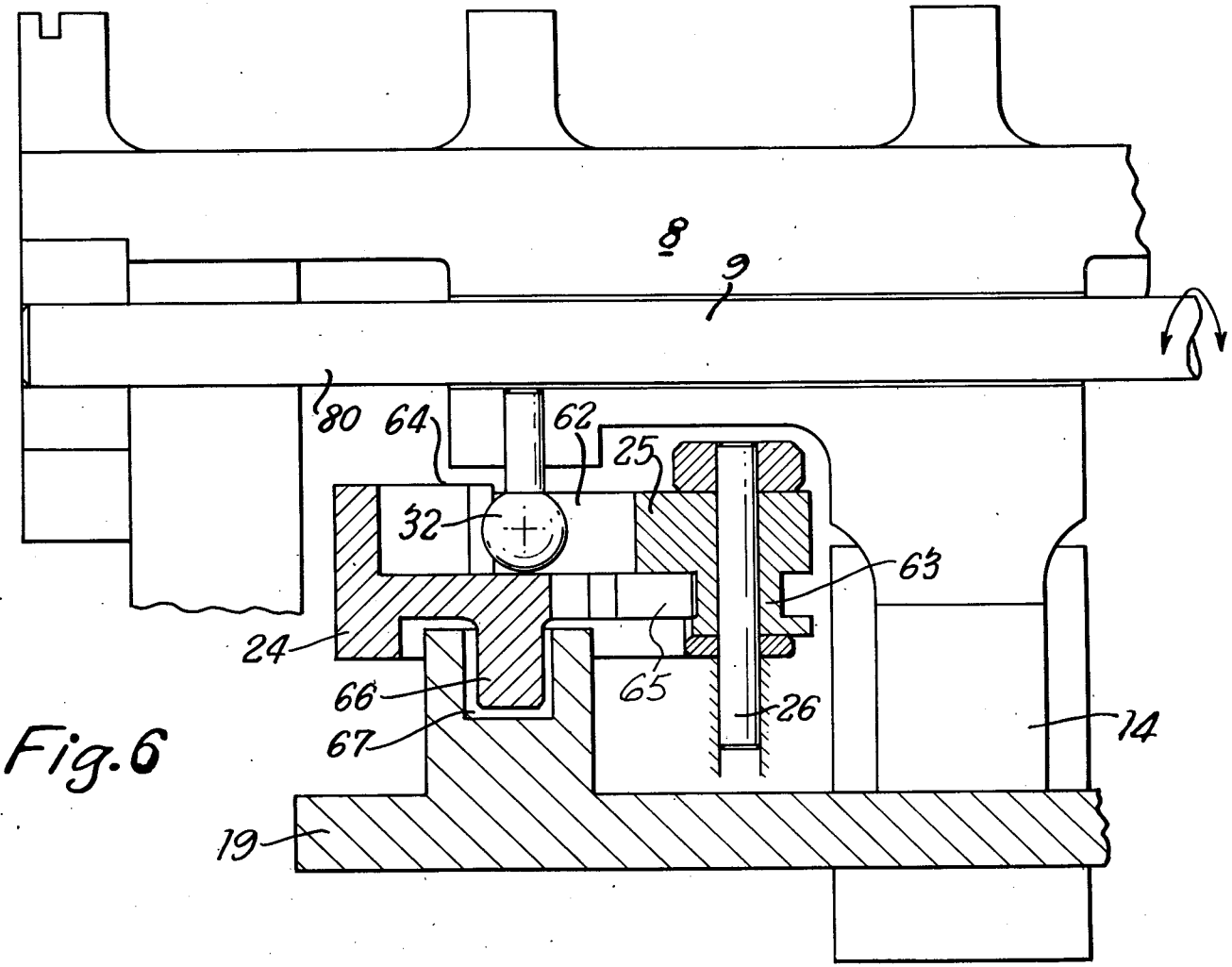

As shown in FIGS. 2 to 6, a ball-headed driver 32 is secured to the cutter block 8. In FIGS. 3 and 4 the arcuate path of movement of the driver 32 is indicated by the arrows EE'. In FIGS. 5 and 6 the driver moves substantially transversely to the plane of the drawing.

A cranked lever 25 is mounted to pivot freely about a pin 26 fixed to the shaver body. One arm of the lever 25 is forked for cooperation with the driver 32 through the intermediary of a coupling element 24 as will be later described. The other arm of the lever 25 is in the form of a part-cylindrical projection 61 which cooperates with clearance in a part-cylindrical recess 69 in the movable trimmer blade 29. When the lever 25 is driven in angular oscillation about the pivot pin 26, the path of movement of the projection 61 is that represented by the arrows FF' in FIG. 3. Accordingly, the movable trimmer blade 29 is linearly reciprocated with the path of movement indicated by the arrows GG', the small transverse component of the arcuate motion of the projection 61 being taken up by the clearance between the projection 61 and the recess 69.

The above-mentioned intermediate coupling element 24 incorporates a U-shaped clip 64 which can be selectively interposed between the driver 32 and the lever 25, in the opening 62 at the forked end of the lever 25, or can be withdrawn from said opening. In the operative position the driver 32 is received in the U-shaped clip 64 which is itself received in the opening 62 at the forked end of the lever 25, whereby the lever 25 is driven in angular oscillation about the pin 26, together with the coupling element 24. The small transverse component of the arcuate motion of the driver 32 is taken up by the mounting of the driver 32 or preferably by permitting a small degree of freedom of movement between the driver 32 and the clip 64 in the transverse direction. In the withdrawn position of the coupling element 24 the driver oscillates freely within the opening 62 at the forked end of the lever 25. The element 24 and lever 25, as well as the movable clipper 29, are stationary in the inoperative or withdrawn position of the coupling element 24.

For selective control of the coupling element 24, a manual control slide 19 is provided, extending as shown in FIG. 2 to the outside of the shaver housing. The coupling element 24 has a boss 66 which loosely engages a slot 67 in the control slide 19. The boss 66 slides along the slot 67 to take up the arcuate movement of the boss 66 about the pivot 26 when the trimmer drive is operative. In the direction transverse to the slot 67, the control slide is manually movable to engage or to disengage the U-shaped clip 64 of the coupling element 24 between the driver 32 and the forked end of the lever 25.

A catch is provided to locate the control slide 19 and thus the coupling element 24 in the operative and inoperative positions. For this purpose the coupling element 24 includes a part in the form of a jumper 65 extending beneath the lever 25 to the region of the pivot pin 26. The jumper 65 is in the form of two spaced apart resilient arms defining a pair of adjacent detents 65*a*, 65*b*. a portion 63 of the lever 25 surrounding the pivot pin 26 is formed with a circular waist to be located in the detents 65*a* or 65*b*, according to the position of the control slide 19. When the trimmer is operative the grooved portion 63 of the lever 25 is located in the detent 65*a*, while when the trimmer is inoperative the portion 63 is located in the detent 65*b*.

To operate the trimmer, the manual control slide 19 is moved from the inoperative FIG. 6 position to the operative FIG. 5 position. The arms of the U-shaped clip 64 are thereby introduced into the opening 62 at the forked end of lever 25 one each side of the driver 32, as best seen in FIGS. 2 and 3. The arms have bevelled tips (see FIG. 3) to facilitate their introduction whilst the driver 32 is in motion. Arcuate oscillation of the driver 32 thereby effects pivotal movement of the cranked lever 25 about the pivot pin 26, the clip 64 also incidentally being driven in reciprocation. Pivotal movement of lever 25 is in turn converted by projection 61 working in slot 69 into the desired linear reciprocation of the movable trimmer blade 29.

It will therefore be seen that there has been particularly described and illustrated an efficient and effective, selectively operable, coupling mechanism for converting angular oscillation of a dry shaver cutter into linear reciprocation of a movable trimmer blade through the intermediary of basically only one further motion, namely the pivotal movement of the cranked lever 25 about axis 26 extending perpendicular to both the shaft 9 and the trimmer element 29.

I claim:

1. An electric dry shaver comprising a cutter, means for mounting said cutter for arcuate oscillation about an axis to effect a shaving action, a driver having an end secured to said cutter and an opposite free end terminated by a ball and adapted to arcuately oscillate about said axis, a trimmer element, means mounting said trimmer element for linear reciprocation parallel to said cutter axis to effect a hair trimming action, and a coupling mechanism including a lever provided with an opening, means defining a pivot axis for said lever and means operably connecting said lever to said trimmer element, whereby oscillation of said lever about said pivot axis effects said linear reciprocation of said trimmer element, and an intermediate member operably interposed between said driver and said trimmer element, said ball end extending into said opening in said lever, said opening having a dimension greater than the arcuate travel of said arcuately oscillating ball end in said opening, said intermediate member being selectively movable into and from said opening to be selectively operatively engageable and disengageable with said ball end of said driver respectively to establish and to break a driving connection between said driver and said trimmer element.

2. A shaver according to claim 1, wherein said lever has a forked portion defining said lever opening, and said intermediate member comprises a U-shaped portion, said U-shaped portion having arms dimensioned for reception in said fork one each side of said driver.

3. A shaver according to claim 1, wherein said pivot axis of said lever extends perpendicular to said cutter axis.

4. A shaver according to claim 5, wherein said pivot axis of said lever intersects said cutter axis.

5. A shaver according to claim 1, including a lost-motion connection, said lost-motion connection being disposed between said lever and said trimmer element to provide lost-motion in a direction mutually perpendicular to said pivot axis and to said direction of trimmer element reciprocation.

6. A shaver according to claim 5, wherein said lost-motion connection comprises a projection on said lever, said projection is carried in pivotal oscillation with said lever about said pivot axis, said trimmer element is provided with a slot, and said projection works in said slot.

7. A shaver according to claim 1, including a manually operable control element coupled to said mechanism selectively to engage and disengage said mechanism with said driver.

8. A shaver according to claim 7, including catch means associated with said mechanism, said catch means being adapted to restrain said mechanism in said engaged and in said disengaged positions thereof.

9. A shaver according to claim 1, wherein said coupling mechanism comprises a fixed pivot pin extending substantially perpendicular to the cutter axis, a cranked lever mounted for pivotal oscillation about said pivot pin, a lost-motion connection between said lever and said trimmer element to provide lost-motion in a direction mutually perpendicular to said pivot pin and to said direction of trimmer element reciprocation so that pivotal oscillation of said lever effects said linear reciprocation of said trimmer element, an intermediate member selectively movable between an operative position between said driver and said cranked lever in which arcuate oscillation of said driver effects pivotal oscillation of said lever, and an inoperative position withdrawn from the path of travel of said driver in which said driver oscillates arcuately and said lever is substantially stationary, and a manually operable control element coupled to said intermediate member to move said intermediate member between said operative and said inoperative positions.

* * * * *

UNITED STATES PATENT AND TRADEMARK OFFICE

CERTIFICATE OF CORRECTION

PATENT NO. : 4,114,264

DATED : September 19, 1978

INVENTOR(S) : Alexis E. Buchholz

It is certified that error appears in the above-identified patent and that said Letters Patent are hereby corrected as shown below:

Column 3, Line 7- at the end of the line, "a" should read --A--.

Column 4, Line 15, "claim 5" should read --claim 3--.

Signed and Sealed this

Thirteenth Day of March 1979

[SEAL]

*Attest:*

RUTH C. MASON
*Attesting Officer*

DONALD W. BANNER
*Commissioner of Patents and Trademarks*